US011045054B2

(12) United States Patent
Wang

(10) Patent No.: US 11,045,054 B2
(45) Date of Patent: Jun. 29, 2021

(54) COVER DEVICE, TOILET COVER ASSEMBLY AND TOILET

(71) Applicant: Beijing Xinsanying Technology and Trade Ltd., Beijing (CN)

(72) Inventor: Yanbai Wang, Beijing (CN)

(73) Assignee: BEIJING XINSANYING TECHNOLOGY AND TRADE LTD., Beijing (CN)

( * ) Notice: Subject to any disclaimer, the term of this patent is extended or adjusted under 35 U.S.C. 154(b) by 0 days.

(21) Appl. No.: 16/523,731

(22) Filed: Jul. 26, 2019

(65) Prior Publication Data

US 2020/0305662 A1 Oct. 1, 2020

(30) Foreign Application Priority Data

Mar. 28, 2019 (CN) ..... 201910243392.7

(51) Int. Cl.
*A47K 13/12* (2006.01)

(52) U.S. Cl.
CPC ..... *A47K 13/12* (2013.01)

(58) Field of Classification Search
CPC ..... A47L 3/12
USPC ... 4/234, 236, 240, 237, 242, 251, 222, 238; 16/365
See application file for complete search history.

(56) References Cited

U.S. PATENT DOCUMENTS

| | | | | |
|---|---|---|---|---|
| 4,109,885 | A * | 8/1978 | Pender | B64C 21/06 244/7 R |
| 5,615,520 | A * | 4/1997 | McGuire | E05F 1/065 49/237 |
| 9,439,542 | B2 * | 9/2016 | Chen | A47K 13/26 |
| 9,554,679 | B2 * | 1/2017 | Hong | A47K 13/12 |
| 10,450,733 | B2 * | 10/2019 | Luettgen | E03D 9/005 |
| 10,463,209 | B1 * | 11/2019 | Laundre | A47K 13/12 |
| 2012/0090932 | A1 * | 4/2012 | Liu | A47K 13/12 188/290 |
| 2012/0280078 | A1 * | 11/2012 | Lowe | A47K 10/38 242/597.1 |
| 2013/0333104 | A1 * | 12/2013 | Hong | A47K 13/12 4/236 |
| 2015/0265110 | A1 * | 9/2015 | Chen | A47K 13/26 4/240 |
| 2017/0058500 | A1 * | 3/2017 | Garrels | A47K 13/307 |
| 2019/0063054 | A1 * | 2/2019 | Luettgen | E03D 9/031 |
| 2019/0313863 | A1 * | 10/2019 | Laundre | A47K 13/12 |
| 2020/0002930 | A1 * | 1/2020 | Luettgen | A47K 17/00 |
| 2020/0288927 | A1 * | 9/2020 | Gong | A47K 13/12 |

* cited by examiner

*Primary Examiner* — Lori L Baker
(74) *Attorney, Agent, or Firm* — Birch, Stewart, Kolasch & Birch, LLP

(57) ABSTRACT

A cover device that mounts to a body of a toilet is provided. The cover device includes a cover rotatably mounted to the toilet, a spring coupled to a sleeve of the cover, and a damper coupled to the sleeve of the cover and having a bearing coupled to the spring. The cover is designed to rotate upward relative to the body of the toilet to a generally vertical position to place the spring in a relaxed position. The cover is designed to rotate downward relative to the body of the toilet to a generally horizontal position to place the spring in a compressed position, thereby allowing a maximum elastic force in the spring in the compressed position to rotatably adjust the cover upward relative to the toilet.

10 Claims, 3 Drawing Sheets

COVER DEVICE, TOILET COVER ASSEMBLY AND TOILET

FIELD OF THE INVENTION

The present application relates to the field of sanitary equipment such as seats or covers for various water closets, especially to a cover device, a toilet cover assembly and a toilet.

BACKGROUND OF THE INVENTION

In modern life, toilets, as a type of sanitary wares, are widely used and have become indispensable sanitary devices for people's daily lives. With the economic development and the continuous improvement of people's living standards, the requirements for toilets are increasingly higher. Being water-saving, clean, easy to wash, novel in style, and beautiful in appearance have become main factors to consider in purchase of toilets. In particular, for the use requirement on the toilet cover, especially as men often do not pull up a toilet seat before urination, urine inevitably drips onto the surface of the seat, which brings great inconvenience to the persons who use the toilet subsequently, especially women, so that hygiene cannot be guaranteed effectively, and public facilities are more difficult to control.

SUMMARY OF THE INVENTION

An object of the present application is to provide a cover device, a toilet cover assembly and a toilet, in which the toilet seat can automatically rise slowly without electricity, so as to facilitate keeping cleanness of the seat.

To solve the above-mentioned technical problem, in a first aspect of the present invention, a cover device is provided, which includes a cover, at least one shaft sleeve provided on one end of the cover, wherein the cover device further includes at least one helical spring (also known as a coil spring) and at least one damper; an outer end of the at least one helical spring is fixedly connected to the at least one shaft sleeve, such that the cover applies a compression force to the at least one helical spring when rotating downward; and a bearing of the at least one damper penetrates through the center of the at least one helical spring and is fixedly connected to an inner end of the helical spring, and an outer cylinder part of the at least one damper is fixedly connected to the at least one shaft sleeve, such that the at least one damper resists against elastic force release of the at least one helical spring, wherein the rated elastic force of the at least one helical spring is larger than the gravity of the cover.

In an embodiment, a first groove is formed in the inner wall of the at least one shaft sleeve, and a first protrusion mated with the first groove is formed on the outer side of the outer cylinder part of the damper; or a first protrusion is formed on the inner wall of the at least one shaft sleeve, a first groove mated with the first protrusion is formed in the outer side of the outer cylinder part of the damper; and the first protrusion is engaged into the first groove.

In an embodiment, a hole is formed in the inner wall of the at least one shaft sleeve, wherein the outer end of the at least one helical spring is press-fitted into the hole.

In an embodiment, the cover device further includes at least one spring protective cap sleeved outside the at least one helical spring, wherein the outer end of the at least one helical spring is fixedly connected to the inner wall of the at least one spring protective cap, and the at least one spring protective cap is fixedly connected to the at least one shaft sleeve.

In an embodiment, a second groove is formed in the inner wall of the at least one shaft sleeve, and a second protrusion mated with the second groove is formed on the outer side of the at least one spring protective cap; or a second protrusion is formed on the inner wall of the at least one shaft sleeve, a second groove mated with the second protrusion is formed in the outer side of the at least one spring protective cap; and the second protrusion is engaged into the second groove.

In a second aspect of the present invention, a toilet cover assembly is provided, which includes an outer lid and a seat, the seat being the cover device according to the first aspect of the present invention, wherein the rated elastic force of the at least one helical spring is smaller than the sum of the gravity of the cover and the gravity of the outer lid.

In a third aspect of the present invention, a toilet is provided, which includes a toilet body, the toilet further including the toilet cover assembly according to the second aspect of the present invention and at least one shaft member, wherein a shaft part of the at least one shaft member is sleeved into the at least one shaft sleeve, and the other end of the at least one shaft member is fixedly connected to the toilet body.

In application of the cover device of the present invention to a toilet, when the toilet outer lid is lifted, the seat can automatically turn up slowly, to avoid leaving urine and contaminants on the seat after urination of a man at home, in public utilities or hotels if the seat is not pulled up before urination; in this way, the seat can be well kept clean, providing convenience for the hygiene of a subsequent user, especially a woman. When the outer lid is put down, the seat can fall slowly due to the gravity of the outer lid and the seat, such that the toilet cover falls slowly and is closed. The whole process has no noise, and is safe, hygienic and convenient. The device of the present invention does not need electricity or other support facilities, and is safer and more energy-saving than intelligent electric devices.

The figures are schematic and simplified for clarity, and they just show details which are essential to the understanding of the disclosure, while other details are left out.

DETAILED DESCRIPTION OF THE EMBODIMENTS

The present invention will be fully described below with reference to the accompanying figures and in conjunction with the preferred embodiments.

Further scope of applicability of the present disclosure will become apparent from the detailed description given hereinafter. However, it should be understood that the detailed description and specific examples, while indicating preferred embodiments of the disclosure, are given by way of illustration only.

Figure 1:
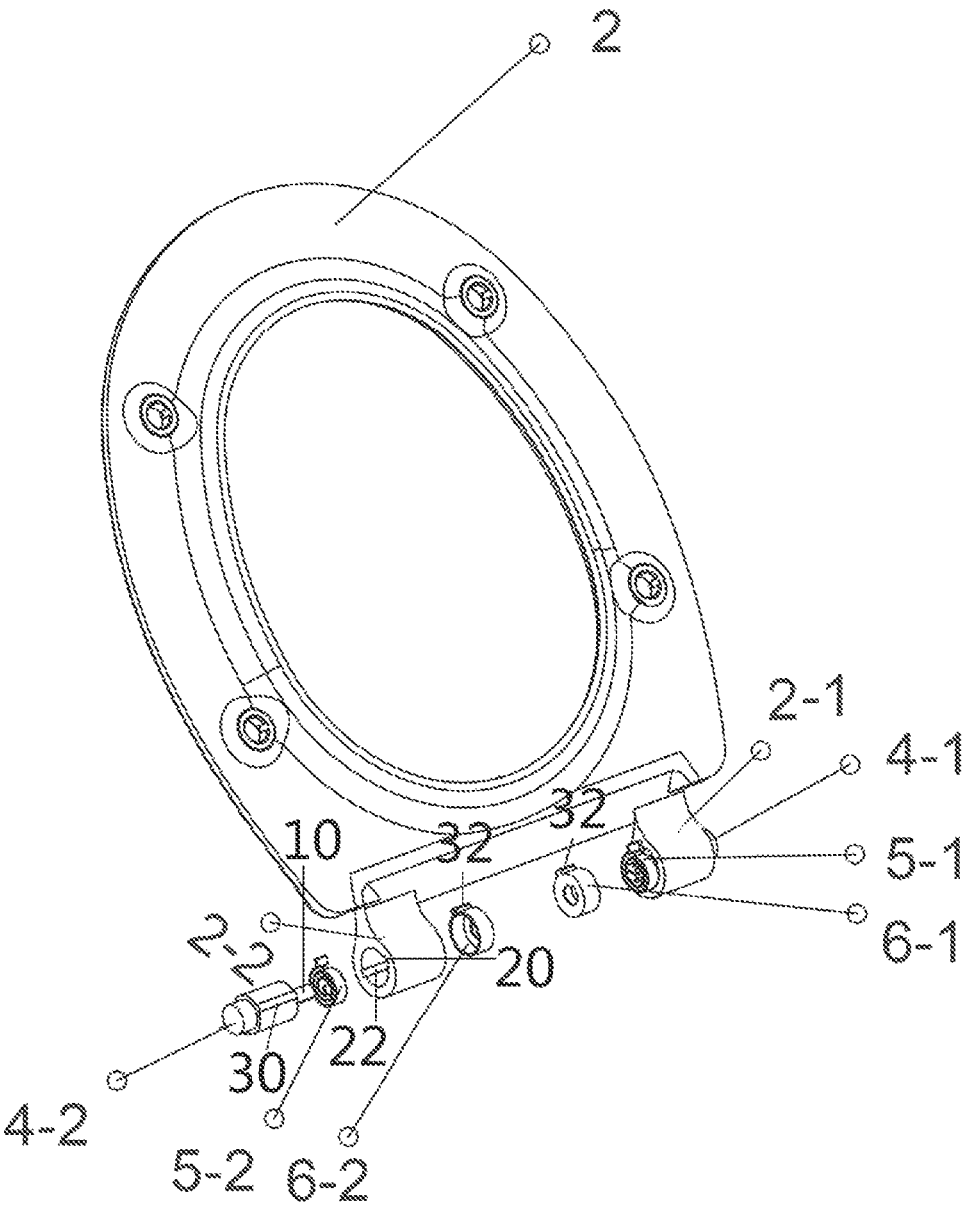
FIG. 1 is a structural exploded diagram of a cover device according to an embodiment of the present invention.
Figure 2:
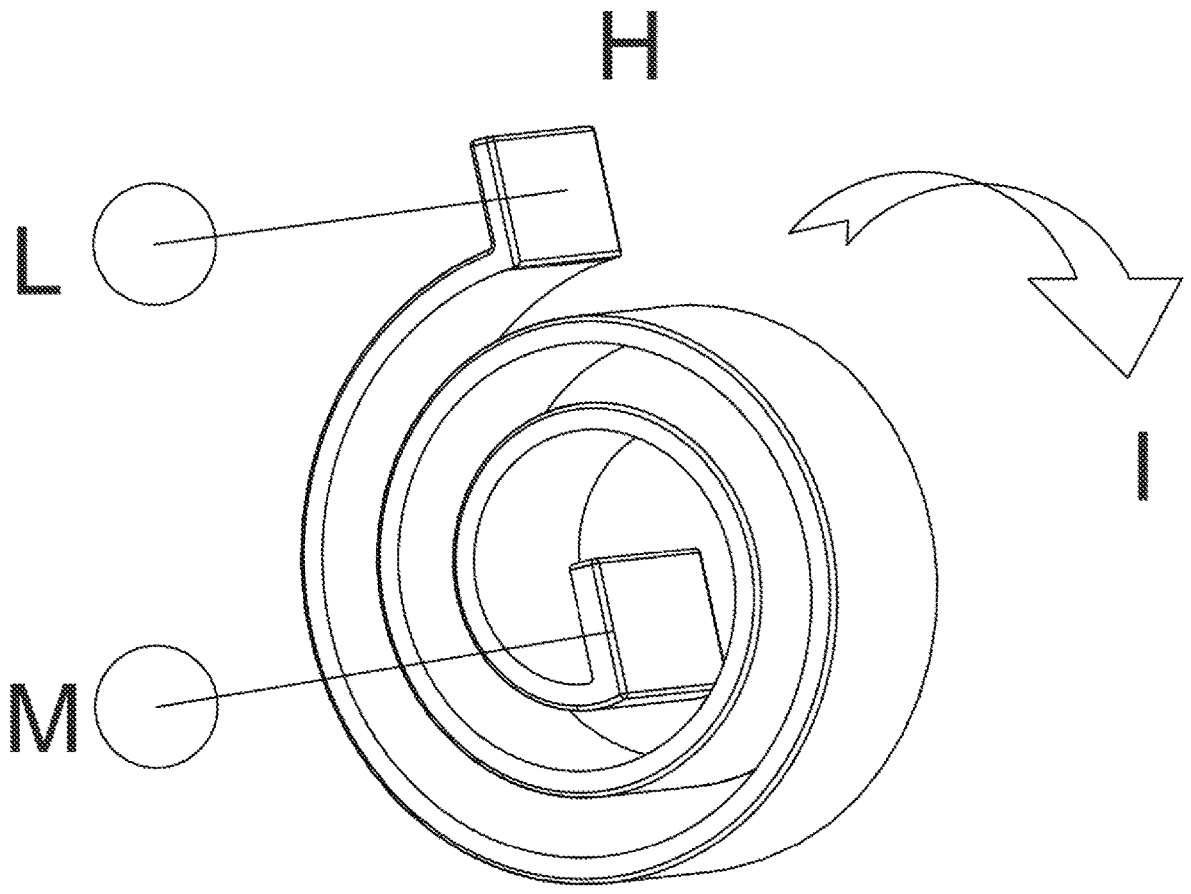
FIG. 2 is a schematic diagram of a helical spring shown in FIG. 1.

FIG. 1 shows a cover device according to an embodiment of the present invention. The cover device includes a cover 2, two helical springs (also called coil springs) 5-1, 5-2, two dampers 4-1, 4-2 and two spring protective caps 6-1, 6-2. Two separate shaft sleeves 2-1, 2-2 are arranged at two opposite sides of one end of the cover 2. A first groove 20 and a second groove 22 are formed in the inner wall of each of the shaft sleeves 2-1, 2-2, a first protrusion 30 mated with the first groove 20 is formed on the outer side of an outer cylinder part of each of the dampers 4-1, 4-2, and a second protrusion 32 mated with the second groove 22 is formed on the outer side of each of the spring protective caps 6-1, 6-2. The helical springs 5-1, 5-2 are sleeved into the spring protective caps 6-1, 6-2 respectively, and outer ends L thereof are fixedly, connected to the inner walls of the spring protective caps 6-1, 6-2 respectively, for example the outer ends L being press-fitted into the second hollow protrusions 32. The spring protective caps 6-1, 6-2 facilitate protecting the helical springs 5-1, 5-2 from deformation and preventing the helical springs from damaging the shaft sleeves 2-1, 2-2. In an alternative embodiment, a hole is formed in the outer side of each of the spring protective caps and the outer end of the helical spring is press-fitted into the hole so that the helical springs are fixedly connected to the spring protective caps respectively. Of course, it may also adopt any other proper fixedly connecting means. Bearings 10 of the dampers 4-1, 4-2 respectively penetrate through the centers of the helical springs 5-1, 5-2 and are fixedly connected to inner ends M of the helical springs. The second protrusions at the outer side of the spring protective caps 6-1, 6-2 are engaged into the second grooves in the inner walls of the shaft sleeves 2-1, 2-2 respectively, and the first protrusions on the outer cylinder parts of the dampers 4-1, 4-2 are engaged into the first grooves in the inner walls of the shaft sleeves 2-1, 2-2 respectively. The helical springs 5-1, 5-2 are mounted to be in a relaxed state when the cover 2 is in a substantially vertical position. When the cover 2 is pressed down and rotates downward about shaft members arranged in the shaft sleeves 2-1, 2-2, the distal ends L of the helical springs 5-1, 5-2 move with the cover 2 to apply a compression force on the helical springs 5-1, 5-2; that is, the helical springs 5-1, 5-2 come into a gradually tightened and stressed state with the falling of the cover 2. When the cover 2 falls to a substantially horizontal position, the helical springs 5-1, 5-2 substantially reach their rated elastic forces (maximum set elastic forces), wherein the sum of the rated elastic forces of the helical springs 5-1, 5-2 is larger than the gravity (or weight) o the cover 2. When the external force on the cover 2 disappears, as the elastic forces of the helical springs 5-1, 5-2 are greater than the gravity of the cover 2, the helical springs 5-1, 5-2 release the elastic forces thereof, and their distal ends L thus move toward relaxed positions, thereby actuating the cover 2 such that the cover 2 automatically rises up. The dampers 4-1, 4-2 are mounted to resist against the release of the elastic forces of the helical springs 5-1, 5-2 respectively, so that the cover 2 automatically rises slowly, instead of abruptly rising rapidly to cause accidental injury or fright. FIG. 2 schematically shows operation of the helical spring. When the cover 2 falls, the outer end L of the helical spring moves from a position H to a position I, and the helical spring is gradually tightened due to being stressed and thus gets the elastic force. When the external force on the cover 2 disappears, the elastic force of the helical spring is released, and the outer end L of the helical spring gradually moves from the position I to the position H, such that the cover 2 gradually rises from the horizontal position to the vertical position.

In other embodiments, the cover device may not include the spring protective caps. In this case, the outer end of the helical spring is directly fixedly connected to the inner wall of the shaft sleeve. For example, a hole is formed in the inner wall of the shaft sleeve and the outer end of the helical spring is press-fitted or snapped into the hole to achieve fixed connection.

In other embodiments, the first groove may be formed in the outer side of the outer cylinder of the damper, and the first protrusion may be formed on the inner wall of the shaft sleeve; and/or the second groove may be formed in the outer side of the spring protective cap, and the second protrusion may be formed on the inner wall of the shaft sleeve.

In other embodiments, the cover may only include one shaft sleeve. In this case, only one helical spring (the spring protective cap may be provided or not) is mounted in the shaft sleeve, and correspondingly, only one damper is provided. Alternatively, at each of the two ends of a single shaft sleeve, one helical spring (the spring protective cap may be provided or not) is mounted, and each helical spring is connected to a damper respectively.

In other embodiments, the fixed connection may also be achieved by one or more of the following means: welding, bonding, riveting, screwing, bolting or other means that makes it impossible to move relative to each other.

Figure 3:
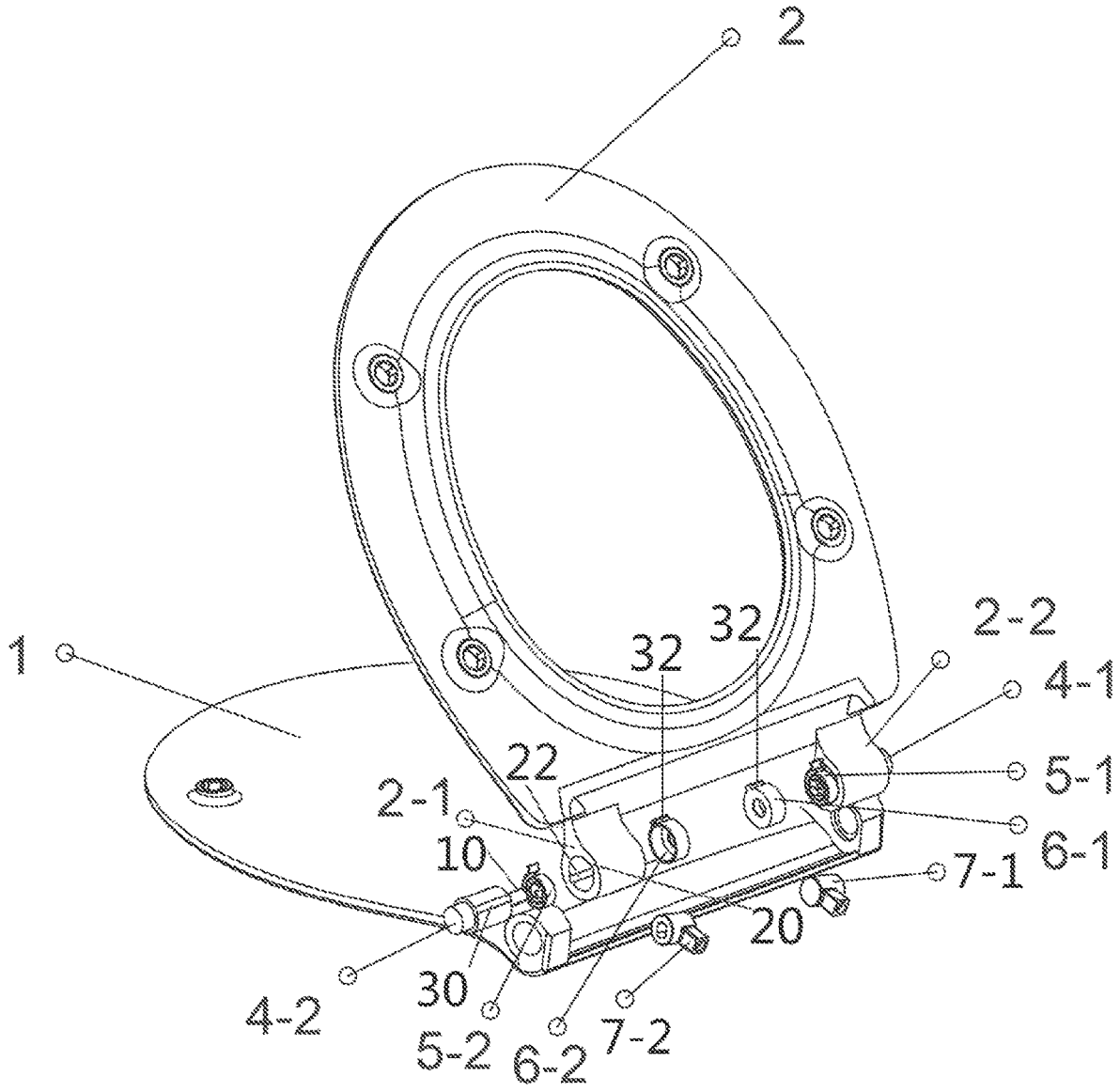
FIG. 3 is an exploded diagram of a toilet cover assembly according to an embodiment of the present invention.

FIG. 3 shows an application of the cover device shown in FIG. 1 to a toilet cover. The toilet cover assembly includes an outer lid 1 and a seat, wherein the seat has a structure of the cover device shown in FIG. 1, and the outer lid 1 covers the outside of the cover 2 and can rotate co-axially therewith. In this case, the sum of the rated elastic forces of the helical springs 5-1, 5-2 should be smaller than the sum of the gravity of the cover 2 and the gravity of the outer lid 1. When the outer lid 1 falls, the cover 2 is caused to fall, and as the pressure of the outer lid 1 and the cover 2 (seat) is greater than the upward elastic force of the helical springs, the entire toilet cover is closed to achieve the purpose of resisting odour, and preventing bacteria from spreading instantly during flushing. When the outer lid 1 is opened, as the gravity of the seat is smaller than the upward elastic force of the helical springs, the seat can automatically rise to avoid being contaminated by urine. Due to the presence of the dampers 4-1, 4-2, the seat does not rise abruptly, but rises slowly and falls slowly, to avoid a user being frightened or accidentally injured. FIG. 3 also shows shaft members 7-1, 7-2 for fixing the toilet cover assembly to a toilet body (not shown). Shaft parts of the shaft members 7-1, 7-2 are configured to be sleeved into the shaft sleeves 2-1, 2-2, so that the toilet cover assembly can rotate about the shaft parts. The other ends of the shaft members 7-1, 7-2 are configured to be fixedly connected to the toilet body, e.g. being fixedly connected to the toilet body through bolts, nuts or the like.

The multiple different embodiments described here or specific features, structures or characteristics thereof can be combined properly in one or more implementations of the present invention.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items.

Although some preferred embodiments of the present invention have been described herein, it is emphasized that the present invention is not limited to these embodiments. Instead, it may be implemented as other embodiments within the scope of the subject matter of the invention, and other embodiments do not necessarily include all the elements in the above described embodiments.

The invention claimed is:

1. A cover device configured to mount to a lid to form a toilet cover assembly, the toilet cover assembly mounted to a body of a toilet, the cover device comprising:

a cover rotatably mounted to the body of the toilet and comprising a sleeve;

a spring coupled to the sleeve of the cover and comprising an outer end and an inner end, the outer end of the spring coupled to the sleeve of the cover; and a damper coupled to the sleeve of the cover and comprising a bearing extending through the spring so that the bearing is coupled to the inner end of the spring;

wherein the cover is configured to rotate upward relative to the body of the toilet to a generally, vertical position to place the spring in a relaxed position, and the cover is configured to rotate downward relative to the body of the toilet to a generally horizontal position to place the spring in a compressed position, thereby allowing a maximum elastic force in the spring in the compressed position to rotatably adjust the cover upward relative to the body of the toilet.

2. The cover device of claim 1, wherein the damper is configured to resist a release of the elastic force in the spring.

3. The cover device of claim 2, wherein one of the damper and the sleeve comprises a first groove and the other one of the damper and the sleeve comprises a first protrusion, the first groove and first protrusion configured to mate with each other.

4. The cover device of claim 2, further comprising a protective cap coupled to the sleeve and extending around the spring.

5. The cover device of claim 4, wherein the outer end of the spring is coupled to an inner wall of the protective cap.

6. The cover device of claim 5, wherein one of the sleeve and the protective cap comprises a second groove and the other one of the sleeve and the protective cap comprises a second protrusion, the second groove and second protrusion configured to mate with each other.

7. A toilet cover assembly configured to mount to a body of a toilet, the toilet cover assembly comprising:

a lid rotatably mounted to the body of the toilet;

a cover rotatably mounted to the body of the toilet and comprising a sleeve;

a spring coupled to the sleeve of the cover and comprising an outer end and an inner md, the outer end of the spring coupled to the sleeve of the cover; and a damper coupled to the sleeve of the cover and comprising a bearing extending through the spring so that the bearing is coupled to the inner end of the spring;

wherein the cover is configured to rotate upward relative to the body of the toilet to a generally vertical position to place the spring in a relaxed position, and the cover is configured to rotate downward relative to the body of the toilet to a generally horizontal position to place the spring in a compressed position, thereby allowing a maximum elastic force in the spring in the compressed position to rotatably adjust the cover upward relative to the body of the toilet.

8. The toilet cover assembly of claim 7, wherein the lid and cover are configured to rotatably adjust together toward the body of the toilet to a closed position to create pressure in the spring that is greater than the elastic force in the spring.

9. The toilet cover assembly of claim 8, wherein the lid is configured to rotatably adjust to an open position to enable the elastic force in the spring in the compressed position to rotatably adjust the cover upward relative to the body of the toilet.

10. The toilet cover assembly of claim 9, further comprising a shaft member comprising a shaft part sleeved into the sleeve of the cover and a portion of the shaft member coupled to the body of the toilet.

* * * * *